US006527167B1

(12) United States Patent
Sheffer

(10) Patent No.: US 6,527,167 B1
(45) Date of Patent: Mar. 4, 2003

(54) ONE PIECE FOLDED AND GLUED CONTAINER

(75) Inventor: Phil B. Sheffer, Thomasville, PA (US)

(73) Assignee: Pack 'N' Stack, Philadelphia, PA (US)

( * ) Notice: Subject to any disclaimer, the term of this patent is extended or adjusted under 35 U.S.C. 154(b) by 0 days.

(21) Appl. No.: 10/009,582

(22) PCT Filed: May 7, 1999

(86) PCT No.: PCT/US99/10019

§ 371 (c)(1),
(2), (4) Date: Mar. 5, 2002

(87) PCT Pub. No.: WO00/68102

PCT Pub. Date: Nov. 16, 2000

(51) Int. Cl.[7] ..... B65D 21/032

(52) U.S. Cl. ..... 229/174; 229/178; 229/186; 229/918; 229/919

(58) Field of Search ..... 229/174, 178, 229/186, 915, 918, 919; 206/509, 511, 512

(56) References Cited

U.S. PATENT DOCUMENTS

| | | | | | |
|---|---|---|---|---|---|
| 2,233,874 | A | * | 3/1941 | Rosenthal | 229/186 |
| 3,102,674 | A | * | 9/1963 | Hamilton | 229/178 |
| 3,656,683 | A | * | 4/1972 | Desmond et al. | 229/186 |
| 4,537,344 | A | * | 8/1985 | Thomas | 229/915 |
| 4,770,339 | A | | 9/1988 | Weimer | 229/143 |
| 5,261,594 | A | * | 11/1993 | Brown et al. | 229/918 |
| 5,330,094 | A | * | 7/1994 | Mertz | 229/178 |
| 5,649,663 | A | * | 7/1997 | Pestow, Jr. | 229/174 |
| 6,155,479 | A | * | 12/2000 | Wellner et al. | 229/186 |
| 6,402,020 | B1 | * | 6/2002 | McClure | 229/918 |

FOREIGN PATENT DOCUMENTS

| | | | | |
|---|---|---|---|---|
| EP | 567425 | A1 | * 10/1993 | 229/174 |

* cited by examiner

*Primary Examiner*—Gary E. Elkins
(74) *Attorney, Agent, or Firm*—Duane Morris LLP

(57) ABSTRACT

A container is made in a collapsed configuration with bellows fold corners for self erection. Outer end wall panels are joined to the container bottom, leading to horizontal ledge panels and inner end wall panels fold over and down to lock via tabs into openings in the bottom. Columns reside under the ledge panels and are provided by column forming panels folded inwardly and glued to the inner end wall panels. Fold lines define the corners of each column and bear against inner sides of the front and back walls holding the columns open. The column forming panels have protruding tabs back by corresponding tabs on one of the ledge panels betwen the inner and outer panels of the end walls. These tabs form a two thickness registration tab that engages a corresponding opening in the container bottom for stacking.

28 Claims, 11 Drawing Sheets

ONE PIECE FOLDED AND GLUED CONTAINER

BACKGROUND OF THE INVENTION

1. Field of the Invention

The invention relates to paperboard, corrugated or similar cartons and containers made in an automated manner by folding panels of an integral flat blank and gluing the panels at key locations. The container is supplied in a collapsed or knocked-down flat configuration. Before loading with product the container is erected manually into a rectilinear box by simple motions. Erection of the folded and glued panels produces certain useful structural attributes such as improved stacking strength, stack alignment, locking of the box in the erected state, etc.

2. Related Art

Corrugated and paperboard containers are made from one or more pieces of flat stock that are cut in required shapes and are assembled to form the walls of a full or partial enclosure. Variations are possible in which several separately-integral parts are formed and then are assembled using glue, tape, staples or the like. For example, the container body and lid may be separate parts, or various types of inserts may be used for reinforcement or other purposes such as subdividing the volume of the container into discrete areas.

Containers are supplied in a collapsed state because storage or handling of empty containers is wasteful of space. The containers are partly formed, with their parts cut out and certain seams and folds provided. The packer erects the containers prior to loading, and finishes any required assembly steps in the process. The loaded containers are finally closed, as suitable for storage or shipment. For example, a container may be cut out from integral flat stock, folded and scored at spaced parallel lines corresponding to the corners of the container (with at least one seam), and supplied with the opposite side and end walls collapsed flat against one another. Top and bottom flaps are likewise integrally attached to the side and end walls at folds or score lines. The packer erects the container from a flat parallelogram into its rectilinear shape, folding the bottom and top flaps inwardly before and after loading, respectively, and finally closing the container at seams that are taped, glued or otherwise attached.

It is efficient if most or preferably all of the container parts are integral parts and extensions of a single piece of flat material. Separate discrete parts such as separate lids, partitions and reinforcing inserts involve manual assembly steps. Manual assembly steps are costly and consume worker time in several ways. In addition, assembly steps can be physically taxing and may lead to repetitive motion injuries. It is preferable if containers are substantially fully formed when supplied, and require the least possible manual action to deploy, load, close and store or pack the containers for shipment. However it is also important for the containers to be structurally sound.

Self-erecting paperboard and corrugated containers are known with their respective wall panels and flaps connected in such a way that one or more of the structural parts of the container is pulled into an erected position as the other parts are erected. Commonly owned pending patent application Ser. No. 09/129,375, filed Aug. 5, 1998, entitled Stackable Container, discloses an integral blank container having folded and glued bellows or gusset corners that couple a bottom panel with side and end wall panels. When the container is erected from the knocked-down-flat state, the assembler need only pull on (or otherwise relatively displace) one of the panels, which pulls all of the panels into a rectilinear shape. In another commonly owned pending patent application Ser. No. 09/253,822, filed Feb. 19, 1999, an integral blank container including end walls with spaced inner and outer end wall panels and an upper/edge is disclosed. Advantageously, the end wall panels and ledge encompass hollow erectable support columns that are associated with upwardly protruding stacking tabs. The internal hollow columns, which are supported by folded and glued panels and are opened under the ledge when the container is in an erected state, vertically reinforce the end walls of the container.

U.S. Pat. No. 4,899,929—Grollman, discloses self-erecting bottom flaps connected to container side walls by folded-back glued gusset panels. The gusset panels are arranged to pull the bottom flaps downwardly into a position perpendicular to the side walls when the side and end walls are unfolded from one another during manual expansion of the container from a flattened parallelogram into a rectilinear box.

The foregoing applications also disclose locking tab structures in which a plural thickness tab protrudes upwardly from the structure of the container end wall to engage in an opening in a similar container stacked thereon. One objective of cartons or containers as described is to support the products that have been loaded into the containers, as well as to bear the load of additional containers that may be stacked on a given container. For this purpose, the panels that are folded and glued can include wall panels having multiple thicknesses of glued-together material and/or partition walls that extend between opposite side walls or end walls. These structural reinforcing features add to the vertical stacking strength or load bearing capacity of the container, namely the maximum vertical weight that can be borne without buckling or displacing the container walls. A container should have good vertical stacking strength, but if possible such stacking strength should be achieved without unnecessarily adding weight to the container and without complicating assembly or erection steps. It is also advantageous if stacking strength can be achieved by means of reinforcements that occupy very little of the space that would otherwise be available for carrying product. Thus, considerations of container strength are sometimes at odds with considerations of weight and volume or ease of assembly.

Containers are routinely stacked vertically to make efficient use of space, and may be reinforced against vertical crushing by employing multiple thickness of material for wall panels or by forming columns, for example as in U.S. Pat. No. 5,330,094—Merz. Known structures that are reinforced in this manner are constructed using added-in insert pieces or using a container structure that requires various manual operations in order to install or erect the reinforcing structure.

Two or more containers are often stacked in vertical registry to be carried manually, to be stacked in a storage area or for shipping on a pallet or the like, in any number of adjacent columns or in a staggered overlapping arrangement resembling masonry. Stacking maximizes the density of storage, and often enables a group of containers to be handled conveniently as a structural unit, e.g., when using a fork-lift truck or a two wheel hand dolly.

Containers in stacks can be subjected to various vertical and lateral forces. Vertical compression force is applied by the weight of upper containers in a stack and the product they contain. This vertical force is borne by the vertically extending structural elements of the underlying cartons. The structural elements that bear vertical forces on a carton or similar container normally occupy only a very limited span of lateral width and/or depth. For example, the vertical forces on many cartons are borne exclusively by their vertical side and end walls. If the stacked cartons remain in registry, then the weight of each upper container is coupled, by the side and end walls of the upper container, to the corresponding side and end walls of an underlying container aligned with the upper container. The side and/or end walls of the upper and lower containers are disposed directly over and under one another over a lateral width and depth of each wall (normally one thickness of material).

If the stacked containers become displaced from exact registry, vertical support may be lacking. It is possible to enlarge the lateral width and depth of the side or end walls of a container such that a ledge is defined on which an upper container may rest. Thus support is provided up to a certain amount of misalignment in the container stack equal to the width of the ledge. Examples of ledge structures are disclosed in the foregoing Sheffer applications. Registry tabs are also provided in U.S. Pat. No. 5,839,650—Sheffer. However, it is difficult to arrange for a ledge in a manner that is consistent with the objectives of fold-and-glue cartons, for example, to provide a knocked-down-flat pre-erection blank for shipping that can be erected with a minimum of manual actions, to conserve container volume of product, and to ensure adequate vertical stacking strength. It would be advantageous if these objectives could all be balanced to provide an optimal container.

The present invention, as in the Sheffer pending applications, provides a site-erected container or carton that is at least substantially formed wholly from an integral flat blank. The only assembly required is erection from a knocked-down-flat configuration by folding the end walls into position to lock into the bottom panel. In so doing, the end and side walls are simultaneously erected perpendicular to the bottom panel. The end walls are provided with registry tabs on a stacking ledge, and are reinforced. The container is supplied with substantially all its joints pre-attached but in a knocked-down-flat state. The container can be produced automatically using a fold-and-glue container production machine, for example as available from Bobst Group, Inc., 146 Harrison Avenue, Roseland, N.J. 07068 (affiliated with Bobst, S A, Lausanne, C H). At the loading site the user need only fold the end panels into place, fill the container and press down the top flaps to produce a stackable unit that is readily handled, stacked on a pallet, or otherwise processed for storage or shipment.

SUMMARY OF THE INVENTION

It is an object of the invention to structure a fold-and-glue knocked-down flat container blank so as to improve the vertical stacking strength of the erected container while also decreasing the reliance on correct registry of the containers by manual action.

It is another object to provide hollow vertical reinforcing columns in the end or side walls of a container, which columns are erectable from a folded flat configuration during erection of the container.

It is an object to minimize the manual steps needed to erect the container as described, in particular to cause the end and side walls of the container to erect into a vertical position and the hollow vertical columns to open and deploy, simply by folding end wall flaps inwardly over the columns to lock on the inner bottom wall of the container.

It is a further object to deploy a protruding registry tab when folding the end wall flaps inwardly, to place the registry tab at a space from the outer end walls of the container, and to use the registry tab not only as a structure for engaging with the underside of a next higher container in a stack, but also as a barb against which the free edges of the sidewall flaps can be locked for a lidded closure.

It is another object of the invention to structure a fold-and-glue knocked-down flat container blank so as to improve the vertical stacking strength of the erected container by providing structural support to the sidewalls of the container while also decreasing the reliance on correct registry of the containers by manual action.

It is a further object to minimize the manual steps needed to erect the container as described, in particular to cause the end and side walls of the container to erect into a vertical position, simply by folding end wall flaps inwardly to lock on the inner bottom wall of the container while deploying sidewall support structures.

These and other objects are accomplished in one embodiment of the invention by a container made in a collapsed configuration with bellows fold corners for self-erection, having spaced-panel end walls encompassing hollow columns for vertical reinforcement. An outer end wall panel is joined to the container bottom, leading to a ledge panel that is horizontal when the container is erected, and an inner end wall panel folds over and down to lock via tabs into openings in the bottom. Hollow columns reside under the ledge panel and are provided by column-forming panels folded inwardly and glued at key points to the inner end wall panels such that the hollow columns are pressed open when the inner end wall panel is folded inwardly and is disposed between the front and rear walls. Score or fold lines define the corners of each hollow column, and are placed to bear against inner sides of the front and back walls, which hold the hollow columns open when the container is erected. The column-forming panels have protruding tabs that are backed by corresponding tabs located on the ledge panel between inner and outer panels of the end walls. These tabs join to form a two thickness registration tab that is used to engage a corresponding opening in the container bottom when two or more containers are stacked together. The registration tab is barb shaped, having laterally opposite stepped edges dimensioned and located such that edges of the top panel flaps pass resiliently and are locked down by the stepped edges when the top panel flaps are folded downwardly to engage the registration tab. The container can be made entirely automatically in a knocked-down-flat state by application of glue and folding at the appropriate lines, and can be erected in a single two-handed motion.

In an alternative embodiment of the invention, a container is provided that is made in a collapsed configuration with bellows fold corners for self-erection, having spaced-panel end walls and resilient wing panels for vertical and lateral reinforcement of the containers sidewalls. An outer end wall panel is joined to the container bottom, leading to a ledge panel that is horizontal when the container is erected, and an inner end wall panel folds over and down to lock via tabs into openings in the bottom. The resilient wing panels reside at the outer peripheral edges of the inner end wall panel, and are provided by partially prescoring and pre-creasing a panel flap. In this way, each panel flap may be folded back upon itself and a portion of the inner surface of the inner end wall panel along the partially scored portion of the flap so as to form a wing panel. As a result, the wing panel may be bent along the pre-crease so that the wing panel is partially folded along the pre-crease. The wing panel contributes to the stacking strength of the container and is folded to a right angle rather than being opened into a hollow shape, by pressure from the front and rear walls. The outer end walls have protruding tabs on the inner panel of each end wall. These tabs join to form a single thickness registration tab that is used to engage a corresponding opening in the container bottom when two or more containers are stacked together. The registration tab is also barb shaped, having laterally spaced stepped edges dimensioned such that edges of the top panel flaps pass and are locked down by the stepped edges when the top panel flaps are folded downwardly to engage the registration tab. The container can be made entirely automatically in a knocked-down-flat state by application of glue and folding at the appropriate lines, and is erected in a single motion.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENTS

Figure 1:
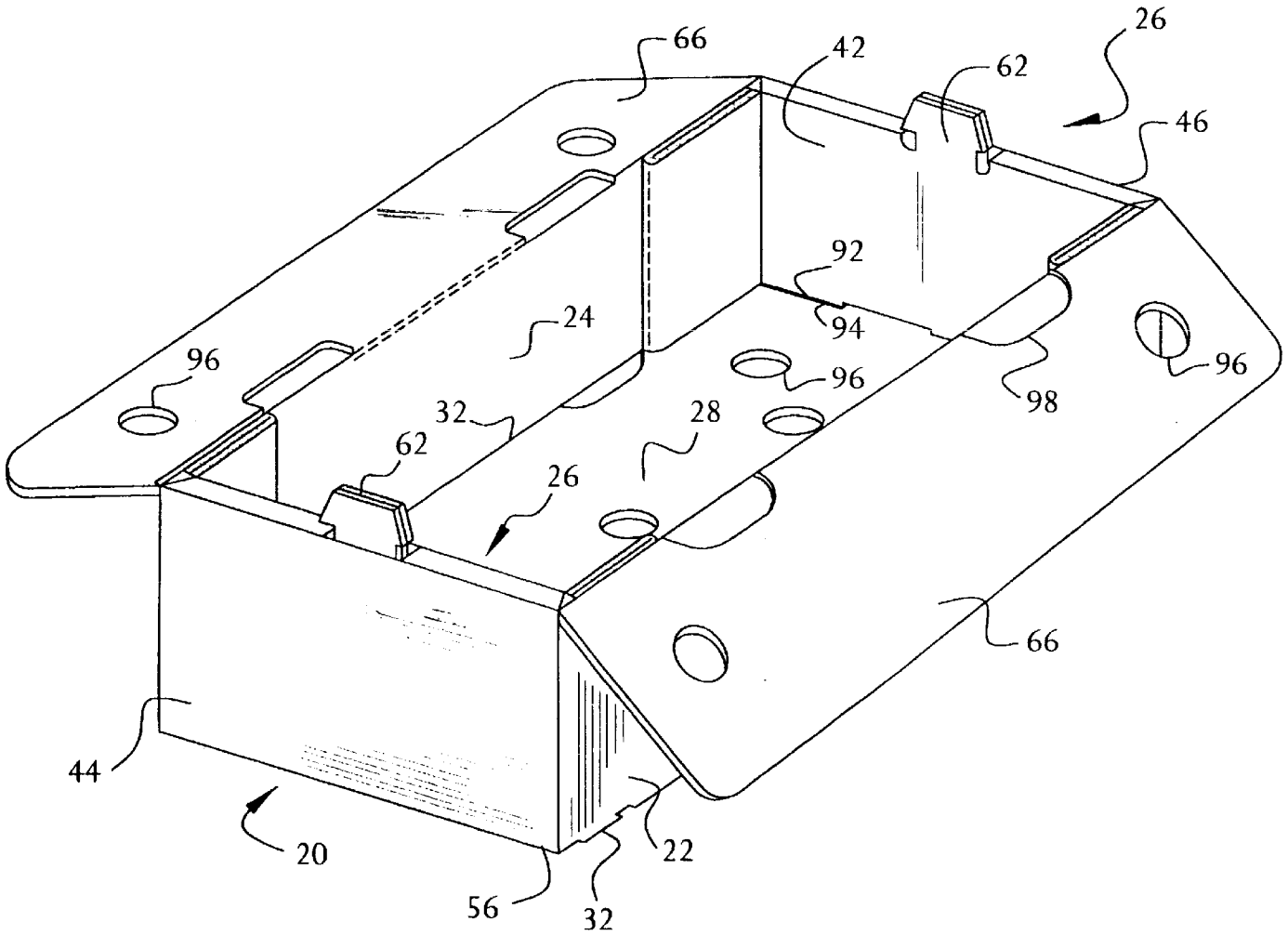
FIG. 1 is a perspective view of an erected container according to one embodiment of the invention.

FIG. 1 shows a vertically reinforced stackable and self-erecting container 20 according to the invention, erected and ready for packing. Container 20 in the open state defines a rectilinear box including a front wall 22, back wall 24, and end walls 26, each extending perpendicularly upwardly from a one piece container bottom 28. Walls 22, 24, 26 are connected to container bottom 28 at right angle fold lines 32. Front wall 22 and back wall 24 are formed of a single thickness of material. Opposing end walls 26 each include an interior panel 42 and exterior panel 44, which are interconnected by, and support, a horizontal ledge panel 46. The panels forming container 20 are cut, folded and attached to one another. Advantageously, all the panels are integral portions of a single flat blank 50, shown in FIG. 2.

It will be appreciated that designations such as "top," "bottom," "front" and "rear," etc. are used in this description for purposes of illustration and to distinguish the relative positions of particular walls and panels. However the invention is not limited to any particular orientation of wall panels.

Blank 50 is arranged by folding and gluing operations to provide a knocked-down-flat ("KDF") structure 52 (best shown in FIG. 6) that can be provided to a packer in a compact collapsed arrangement and has structures that engage one another when the container is erected. These structures provide vertical reinforcement for the end walls 26 via hollow columns 55 confined between interior panel 42 and exterior panel 44 and in part by the inner face of front wall 22 or back wall 24 of container 20. Bellows fold corner structures 56 cause the front, back and end walls to pull one another into an orientation perpendicular to bottom 28 during erection of container 20. Registration tabs 62 and corresponding registration openings 64 permit multiple containers to be stacked in registry as keyed by registration tabs 62.

The combination of an interior panel 42 and exterior panel 44 for each of the end walls 26 provides vertical strength to the container and resistance to lateral deformation. This is in part because end walls 26 comprise multiple thicknesses of material and in part because the spaced end wall interior and exterior panels 42, 44 and ledge panel 46 fit between front wall 22 and back wall 24 and maintain a perpendicular relative orientation between the front and back walls versus the end walls. According to an inventive aspect, the end walls also provide additional support, vertical strength and resistance to deformation due to hollow columns 55, which are opened and erected during erection of the container, to reside between interior panel 42 and exterior panel 44, beneath ledge panel 46 and bearing against the inner surfaces of front wall 22 and back wall 24. Ledges 46, with their underlying support, also provide a pair of lateral areas that function as stable platforms that can support stacking of containers, even if an upper container is out of registry with a lower one by part of the thickness of the ledge panel. In one preferred embodiment, registration tabs 62, associated with interior panel 42 and exterior panel 44, and reinforcing hollow columns 55 keep the stacked containers in registry.

Figure 2:
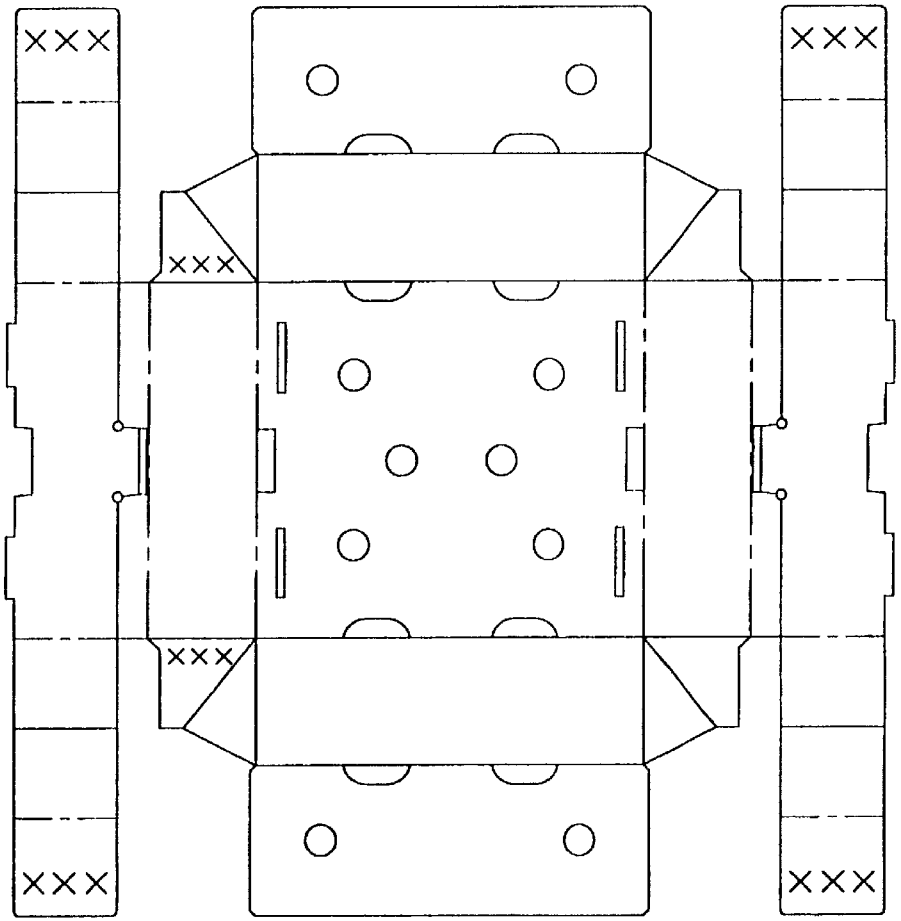
FIG. 2 is a plan view of an integral flat blank prior to being folded, glued, and erected to provide the container shown in FIG. 1.

Referring to FIG. 2, container blank 50 is preferably laid flat, i.e., in the form in which the container is cut as an integral blank from a sheet of flat corrugated board, paperboard or other sheet material. A number of thicknesses can be die cut in a single step. However, blanks 50 preferably are cut out individually so that the blank can be scored or compressed along the lines that are to be folded, at the same time that the perimeter of the blank is cut from the sheet. Along certain lines the blank is folded when it is formed into a collapsed state for shipment, and other lines are folded or partially unfolded when the collapsed blank is erected for packing. Lines representing fold lines are shown in the drawings by broken lines, and can be made by compressing the material along a line, cutting all or part way through the material at spaced intervals, cutting through part of the material thickness, etc.

Blank 50 generally comprises a one piece bottom panel 28 from which front wall 22 and rear wall 24, and opposing end walls 26 radiate in mutually perpendicular directions along bottom-to-side wall fold lines 32. Fold lines 32 will become ninety degree folds when container 20 is placed in its fully erected state. Exterior panels 44 of end walls 26 are relatively nearer to bottom panel 28 than interior panels 42, but are termed "exterior" panels because they define the outside end surface of container 20 when the container has been erected.

Column-forming panel 74 extends laterally beyond interior panel 42. Column-forming panel 74 is folded laterally inwardly along an outermost fold line 78 that is spaced laterally outwardly from fold line 32 joining bottom 28 to front wall 22 or back wall 24. Column-forming panel 74 is glued to interior panel 42 at key places, in this embodiment exclusively at a space from the fold lines of column-forming panel 74, leaving the column-forming panel free to expand from a flattened parallelogram into a rectilinear cross-section. The erected hollow column bears resiliently against the inside surface of front wall 22 or back wall 24, which holds column 55 open.

Column-forming panel 74 has four parallel spaced score or fold lines 76, 78 located at the corners of each hollow column 55. Hollow column 55 is rectangular in cross-section, and fits in the space between interior and exterior panels 42, 44. In the embodiment with symmetrical column-forming panels folded inwardly from opposite lateral sides, each of the column forming panels has half of a protruding registration tab 62 at its end glued to interior panel 42. Each interior panel 42 has locking tabs 92 oriented longitudinally. Locking tabs 92 engage in locking tab receptacles 94 in container bottom 28, when interior panel 42 is folded into the space between front wall 22 and back wall 24.

Registration tab portions 84 of column-forming panels 74 are preferably backed by a registration tab portion of exterior panel 44, forming a registration tab 62 of two thicknesses. This two thickness registration tab is spaced longitudinally inwardly from exterior panel 44 and is located against interior panel 42 at the inner edge of ledge 46, rather than at the extreme longitudinal end of container 20. The protruding part cut from ledge 46 is coplanar with interior panel 42 and is backed by registration tab portion 84 of column-forming panel 74. These protruding parts together form registration tab 62. Registration tab 62 extends upwardly from ledge 46 by a distance greater than the thickness of top or lid panels 66.

The protruding parts of interior panel 42 and column-forming panel 74 are positioned in registry with a registration opening 102 in bottom 28 of container 20 such that container 20 is stackable in registry with similar containers by insertion of registration tab 62 into registration opening 102. Column-forming panel 74 has an indentation 86 opposite from and complementary with its protruding registration tab 62. The inner column-forming panel can have an indentation corresponding to its protrusion as well, whereby registration tab 62 of container 20 fits exactly into registration opening 102 of a container stacked thereon. However, the inner column-forming panel also can be arranged without such an indentation. In that case, registration tab 62 of container 20 is resiliently deflected longitudinally outwardly around interior panel 42 and column-forming panel 74. Registration opening 102 is sufficiently wide to accommodate this deflection (i.e., the opening is double the width of the tab in the longitudinal direction). This structure is such that registration tab 62 locks securely in registration opening 102 of the next upper stacked container, and together with column-forming panel 74 of the upper container occupies most or all of the space between interior and exterior panels 42, 44.

Registration tab 62 has a stepped edge on each lateral side, being shaped as a barb or arrowhead that engages with the edge of top flap 66 when top flap 66 is folded down. Top flap 66, which is attached to one of front wall 22 and back wall 24 at a fold line, is foldable laterally inwardly to define a lid on container 20 and snaps over the barb of the protrusion to lock the container closed without the need for any glue, staples, tape or the like.

Figure 3:
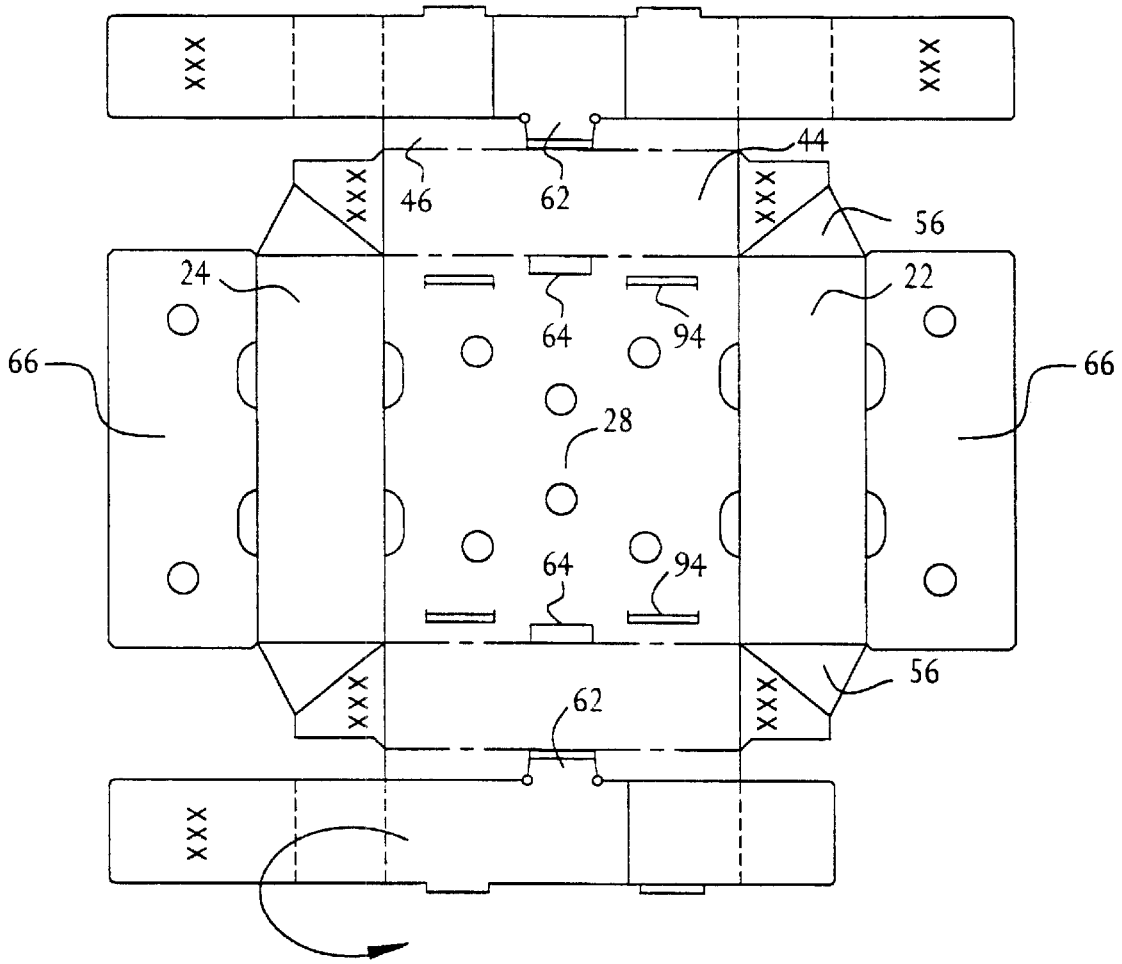
FIG. 3 is a plan view of the integral flat blank of FIG. 2, showing the gluing and folding operations associated with the hollow columns to be opened when erecting the end wall.
Figure 4:
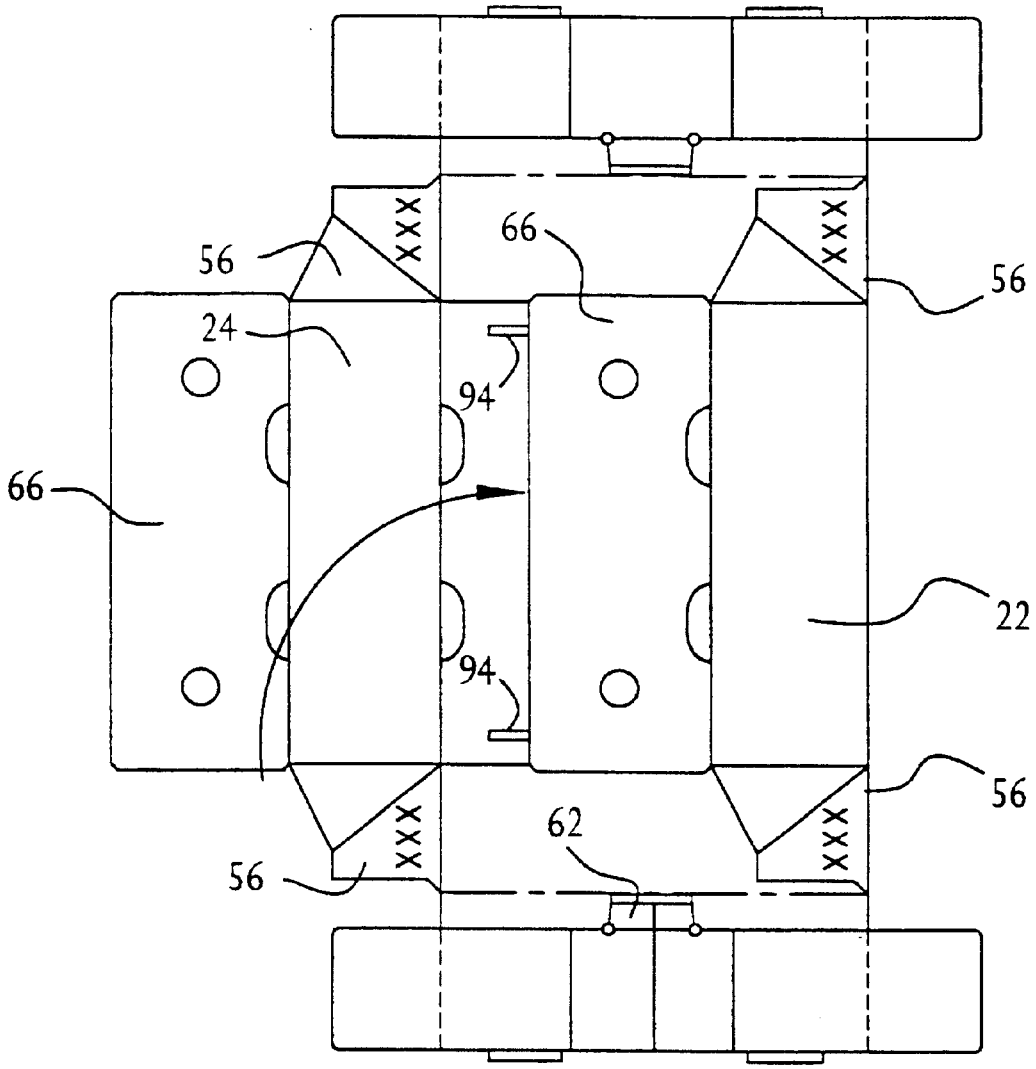
FIG. 4 is a plan view of the integral flat blank of FIG. 3, showing the gluing and folding operations associated with the bellows corners.

Exterior panels 44 are attached to front wall 22 and back wall 24 by bellows or gusset fold joints 56. Bellows or gusset fold joints 56 are tab-like structures extending between the respective walls and panels, at the corners of container 20. Each includes a diagonal fold line 68 that divides the bellows into two substantially triangular portions (see FIG. 2). One triangular portion of bellows joints 56 is joined to exterior panel 44 along a side edge defined by fold line 72. This triangular portion is then glued to exterior panel 44. The other triangular portion of bellows joint 56, across diagonal fold line 68, is attached to the adjacent side wall, but is not glued and can fold relative to its attached side wall and/or relative to the other triangular portion of bellows joint 56 across diagonal fold 68. It should be noted that the portions of bellows joints 56 to which glue is applied are shown in the FIG. 2 by "XXX" patterns. In FIGS. 3 and 4, which illustrate fold-and-glue steps in obtaining KDF blank 52 from flat blank 50, exposed glue areas are likewise shown in "XXX" patterns. Covered areas containing glue on a rear face of a respective panel are shown in broken line "XXX" patterns.

Bellows joints 56 affix front wall 22 and back wall 24 to exterior panels 44 in the collapsed or KDF state of the blank. In the collapsed state, bellows joints 56 are laid flat against one of the adjacent perpendicular panels and the other adjacent perpendicular panel is folded over the first (for example in FIG. 4, back panel 24 is folded over toward exterior panel 44). For erecting container 20, the panels are raised from parallel to ninety degrees relative to bottom 28. For example, in FIG. 4, exterior panel 44 is rotated toward the right and the end wall is rotated upwardly. Bellows joint 56 via their respective triangular portion, pull their connected panel and one another up to ninety degrees relative to bottom 28, and in so doing bellows joints 56 are folded on diagonal fold line 68 to rest in a folded condition against the panel to which one of the bellows joint triangular portions is glued.

Interior panels 42 are reinforced by column-forming panels 74 that extend laterally outwardly from interior panels 42 in flat blank 50. Column-forming panels 74 are folded laterally inwardly in the KDF configuration and are glued to interior panels 42 at areas shown by "XXX" patterns in the drawings. Column-forming panels 74 are scored or folded at four parallel spaced locations 76 that will correspond to the corners of hollow columns 55 after erection of container 20. Initially, in the KDF (knocked-down-flat) configuration, column-forming panels 74 are not folded along the score line that is parallel to fold line 32, between bottom 28 and front wall 22 or back wall 24. Instead, column-forming panels 74 are folded at an outermost score line 78 that is located laterally outward from the bottom/front or bottom/back fold line 32 by a distance equal to the width of ledge panel 46 and the space between interior and exterior panels 42, 44. Column-forming panels 74 are dimensioned so that, as folded laterally inwardly, their extreme ends 82 substantially meet at the longitudinal center line of container 20 (i.e., at the center of an end wall 26). At ends 82, each column-forming panel 74 has an upward extension 84 that forms part of a protruding registration tab on one side. On the opposite side the column-forming panel has an indentation 86 complementary with extension 84. In conjunction with a registration tab opening 64 in bottom 28 of container 20, the indentation 86 provides clearance space for registration tab 62 of a similar container (not shown) on which container 20 may be stacked.

FIG. 3 shows the gluing and folding operation associated with affixing column-forming panels 74 to the surface of interior panel 42, including folding column-forming panels 74 inwardly. FIG. 4 illustrates the step of gluing bellows joint 56 to interior panel 42, including folding front wall 22 and rear wall 24 over bottom 28.

FIG. 4 also shows generally the appearance of the KDF configuration of the blank. In the KDF configuration, the blank is compact in that the internal volume of the container is substantially completely collapsed. The KDF blanks can be stacked and bound for shipment to a packer who erects the containers prior to packing them with product. Inasmuch as erection of the container is a simple operation, the same worker who loads the containers can easily erect them immediately prior to packing.

Figure 5:
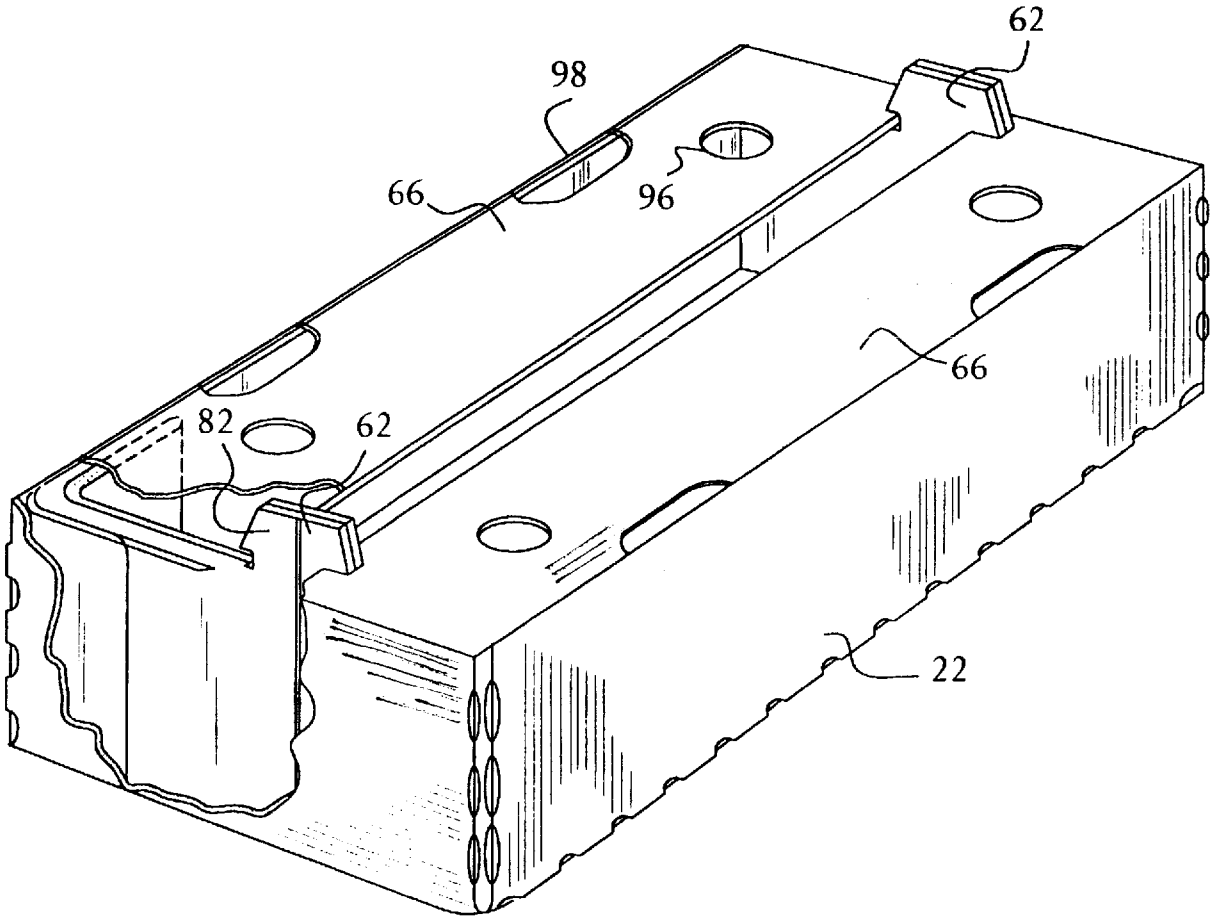
FIG. 5 is a perspective view of the container of FIG. 1, shown with the exterior panel partly cut away to illustrate the internal hollow column formed when in the erected state between the interior and exterior panels.

Container 20 is erected from the KDF state (FIG. 4) to the erected state (FIG. 5), wherein hollow columns 55 are opened from flattened parallelogram shapes and fit into the space between front wall 22 and back wall 24 and between interior and exterior panels 42, 44. More particularly, interior and exterior panels 42, 44 are raised and folded inwardly over and toward bottom 28 until locking tabs 92 extending longitudinally from interior panel 42, lock into locking tab openings 94 provided in bottom 28 of container 20. A ninety degree fold is made between bottom 28 and exterior panel 44, thereby raising front wall 22 and back wall 24 from bottom 28 due to the action of bellows joint 56. Alternatively, front wall 22 and back wall 24 can be raised, simultaneously raising exterior panel 44 due to bellows joint 56 (i.e., either the front/back or end wall can be raised and will pull up the other).

A ninety degree fold is then made between ledge panel 46 and interior and exterior panels 42, 44, respectively. This causes interior panel 42 to fold over and be directed downwardly toward bottom 28 of container 20, where locking tabs 92 fit into their receptacles 94. For example receptacles 94 may comprise narrow slots with adjacent cuts permitting deflection of bottom 28 adjacent the slots to admit locking tabs 92.

Figure 6:
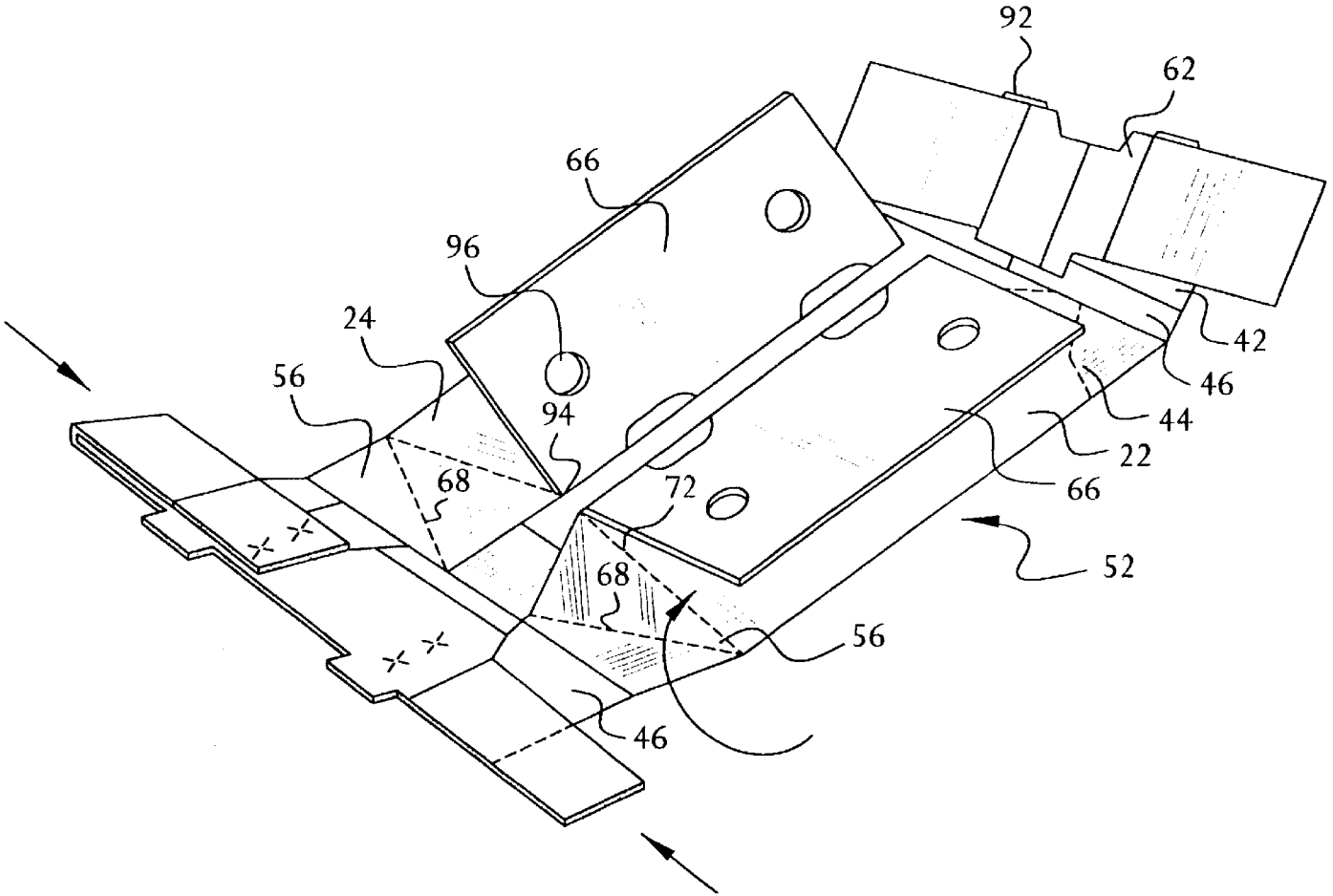
FIG. 6 is a perspective view illustrating an aspect of erecting the container, namely exerting inward lateral force on the column-forming panels to open the hollow panels during folding of the interior panel into the space between the front and back to lock via tabs in the container bottom, as shown in the drawing by arrows.

According to an inventive aspect, column-forming panels 74 are not folded in the KDF state along a line parallel to fold line 32, between bottom 28 and front wall 22 or back wall 24. As a result, column-forming panel 74 protrudes laterally on both sides to its outermost fold 78, beyond the space provided between front wall 22 and back wall 24. This aspect is illustrated in FIG. 6. In order to fit interior panel 42 and column-forming panel 74 between front wall 22 and back wall 24, the worker presses the protruding ends of hollow columns 55, namely folds 78, laterally inwardly while rotating interior panel 42 downwardly to engage locking tabs 92 in receptacles 94. Hollow columns 55 are thereby opened from flattened parallelograms into the rectilinear cross-section shown in FIG. 5. As interior panel 42 enters the space between front wall 22 and back wall 24, lateral inward pressure is exerted on hollow columns 55 by front wall 22 and back wall 24. The result is a snug fit that further stiffens and strengthens container 20.

The exemplary blank shown in the drawings has a number of additional openings 96, 98 in bottom 28 and in top or lid panels 66. These openings are optional but are appropriate, for example, for a container used as an agricultural shipping container for produce or the like. Round openings 96 shown in the central areas of bottom 28 and top panels 66 provide for advantageous air circulation. The approximately oval openings 98 at the junctions of the top or bottom and the side walls also provide for air circulation and have the further benefit of usefulness for hand or finger holds.

Figure 7:
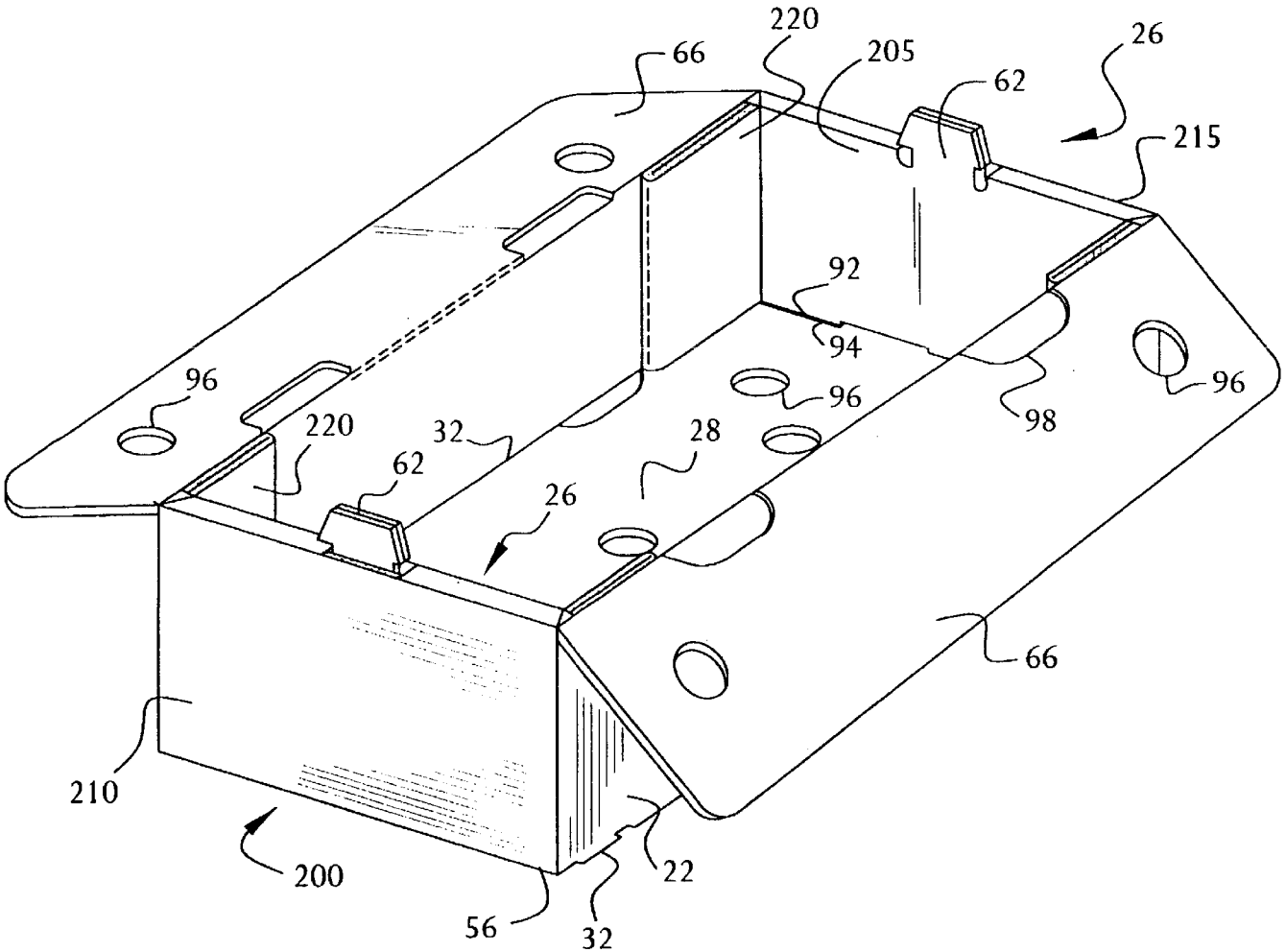
FIG. 7 is a perspective view of an erected container according to another embodiment of the invention.

FIG. 7 shows a vertically reinforced stackable and self-erecting container 200 according to an alternative embodiment of the invention, erected and ready for packing. Container 200 in the open state also defines a rectilinear box including a front wall 22, a back wall 24, and opposing end walls 26, extending perpendicularly upwardly from a one piece container bottom 28. Walls 22, 24, and 26 are connected to container bottom 28 at right angle fold lines 32. Front wall 22 and back wall 24 are formed of a single thickness of material. Opposing end walls 26 each include an interior panel 205 and an exterior panel 210, which are interconnected by, and support, a horizontal ledge panel 215. The panels forming container 200 are die cut from a single flat blank 50, and then trimmed, folded and attached to one another in a manner similar to that disclosed in detail here in above.

Figure 8:
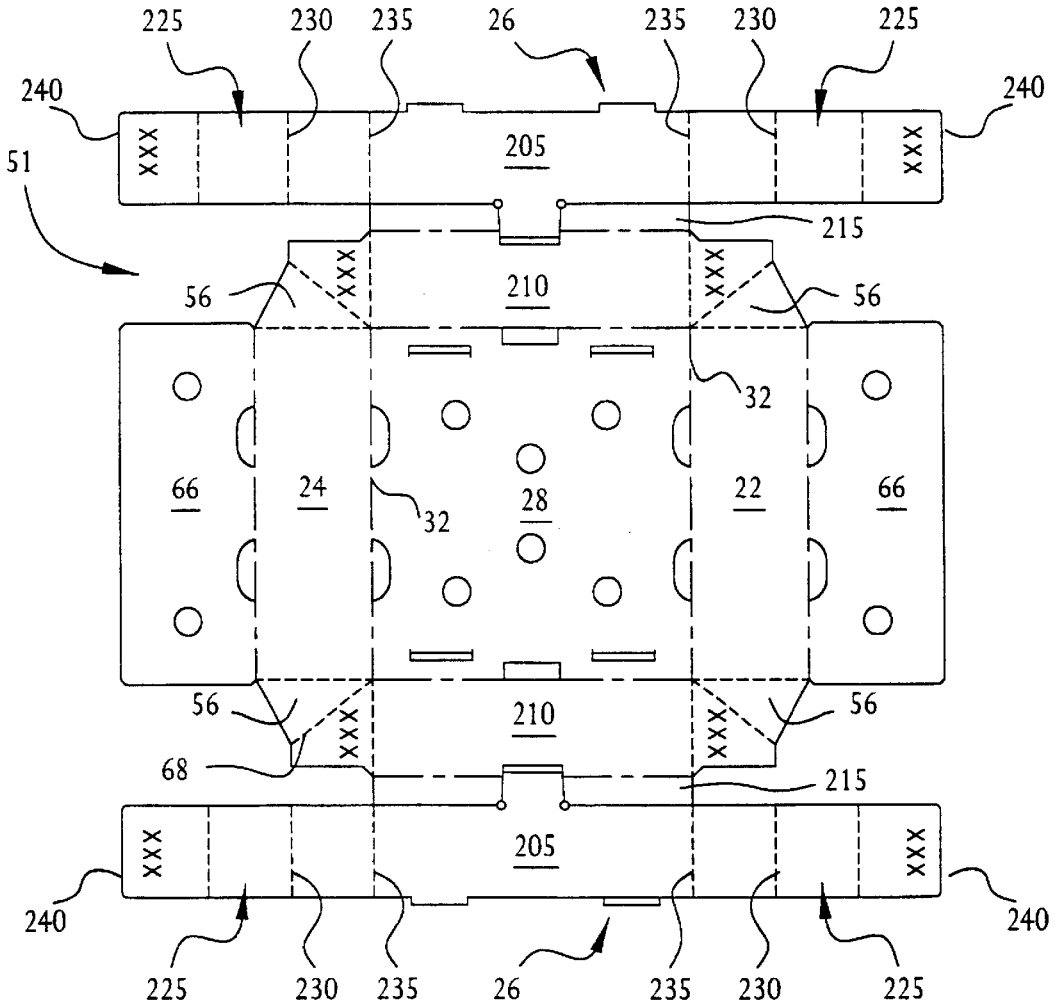
FIG. 8 is a plan view of an integral flat blank prior to being folded, glued, and erected to provide the container shown in FIG. 7.

Blank 51 is arranged by folding and gluing operations to provide a knocked-down-flat ("KDF") structure 53 (best shown in FIG. 8). KDF structure 53 includes means for erection and self-engagement so that KDF structure 53 can be provided to a packer in a compact, collapsed form. More particularly, bellows fold corner structures 56 cause front wall 22, back wall 24, and opposing end walls 26 to pull one another into an orientation perpendicular to bottom 28, during erection of container 200 in substantially the same manner and with substantially the same structures as have been disclosed hereinabove in connection with container 20. Registration tabs 62 and corresponding registration openings 64 provided in the area of ledge panel 215 and in container bottom 28 permit containers to be stacked in registry as keyed by registration tabs 62.

The combination of an interior panel 205 and exterior panel 210 for each of opposing end walls 26 provides vertical strength to container 200 and resistance to lateral deformation. This is in part because opposing end walls 26 comprise multiple thicknesses of material, and in part because interior panel 205, and exterior panel 210 are spaced apart, with ledge panel 215 fit therebetween so as to maintain the perpendicular relative orientation of front wall 22 and back wall 24 with respect to opposing end walls 26.

According to an alternative inventive aspect, opposing end walls 26 also provide additional support, vertical strength, and resistance to deformation due to resilient wings 220, which are pre-formed and deployed upon erection of container 200 to reside along a portion of front wall 22 and back wall 24. Resilient wings 220 are formed and positioned so as to be biased against front wall 22 and back wall 24 when container 200 is fully erected. Ledge panels 215, with their underlying support, also provide a pair of lateral areas that function as stable platforms that can support a corresponding container 20 or 200 stacked on another container 20 or 200, even if an upper container is out of registry with a lower one by part of the thickness of ledge panel 46 or 215. In the preferred alternative embodiment shown, registration tabs 62 associated with interior wall panel 205 and exterior wall panel 210 help keep the stacked containers in registry.

FIG. 8 shows a container blank 51, laid flat, i.e., when cut as an integral blank from a sheet of flat corrugated board, paperboard or other sheet material. A number of thicknesses can be die cut in a single step; however blanks 51 preferably are cut out individually so that the blank can be scored or compressed along the lines that are to be folded, at the same time that the perimeter of the blank is cut from the sheet. Typically, a blank is folded along certain lines when it is in a collapsed state, ready for shipment, and along other lines when the collapsed blank is erected for packing. Lines representing fold lines are shown in the drawings by broken lines, and can be made by compressing the material along a line, cutting all or part way through the material at spaced intervals, cutting through part of the material thickness, etc.

Blank 51 comprises a one piece bottom panel 28 from which front wall 22, and rear wall 24, and opposing end walls 26 radiate in mutually perpendicular directions along bottom-to-side wall score lines 32. Score lines 32 will become 90° fold lines when container 200 is erected to its full formed state. Each exterior panel 210 of each end wall 26 is relatively nearer to bottom panel 28 than each interior panel 205, but is termed an exterior panel because it defines the outside end surface of container 200 when the container has been erected (and vice versa for the interior panels 205). Top or lid flaps 66 are attached along fold lines to front wall 22 and back wall 24 in spaced relation to bottom 28. Ledge panels 215 are attached along fold lines positioned between interior panel 205 and exterior panel 210.

As disclosed in connection with container 20, exterior panels 210 and front and back walls 22, 24 are also attached to one another by bellows or gusset fold joints 56, namely tab-like structures extending between the respective panels at the corners of container 200 and having a diagonal fold line 68.

Opposing end walls 26 are reinforced by resilient wings 220 that project inwardly from each corner of container 200. The wing-forming panels 225 are folded laterally about score lines 230 (FIG. 8) and are glued to the inner surface of interior panel 205 at areas shown by "XXX" patterns in the drawings. Wing-forming panels 225 are scored along score lines 230, which will correspond to the corners of container 200 after erection and deployment. Initially, in the KDF configuration 53, the wing-forming panels 225 are not folded along fold line 235, that is colinear with fold line 32 between bottom 28 and front wall 22 or back wall 24. Instead, the wing-forming panels 225 are folded at outermost score line 230 located laterally outward from fold line 235. Wing-forming panels 225 are dimensioned so that, when folded laterally inwardly, their extreme ends 240 are spaced apart from one another on the surface of interior panel 205 so that the full surface area of each wing-forming panel 225 is in full, surface-to-surface contact with the surface of interior panel 205.

Figure 9:
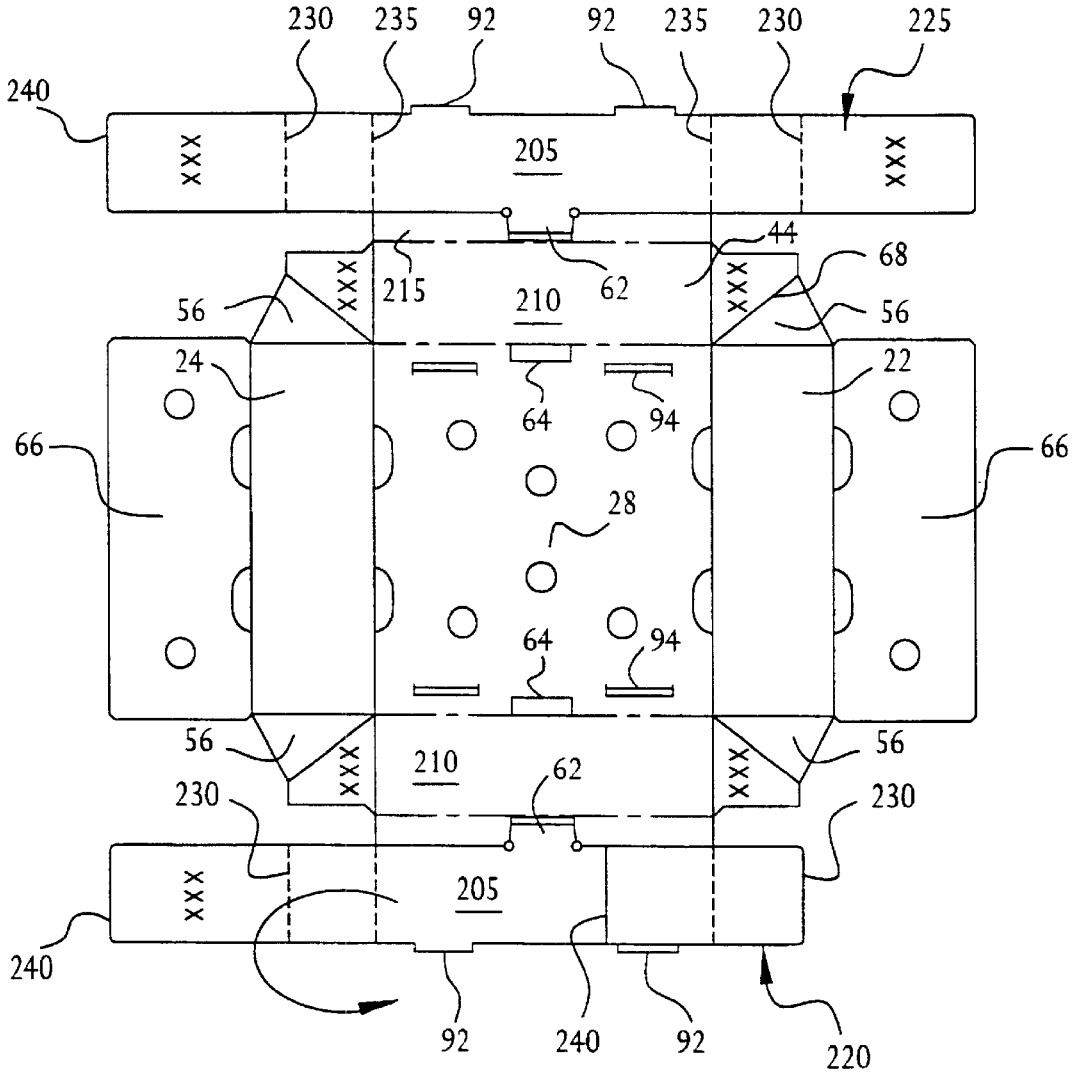
FIG. 9 is a plan view of the integral flat blank of FIG. 8, showing the gluing and folding operations associated with the resilient wing panels to be deployed when erecting the end wall.
Figure 10:
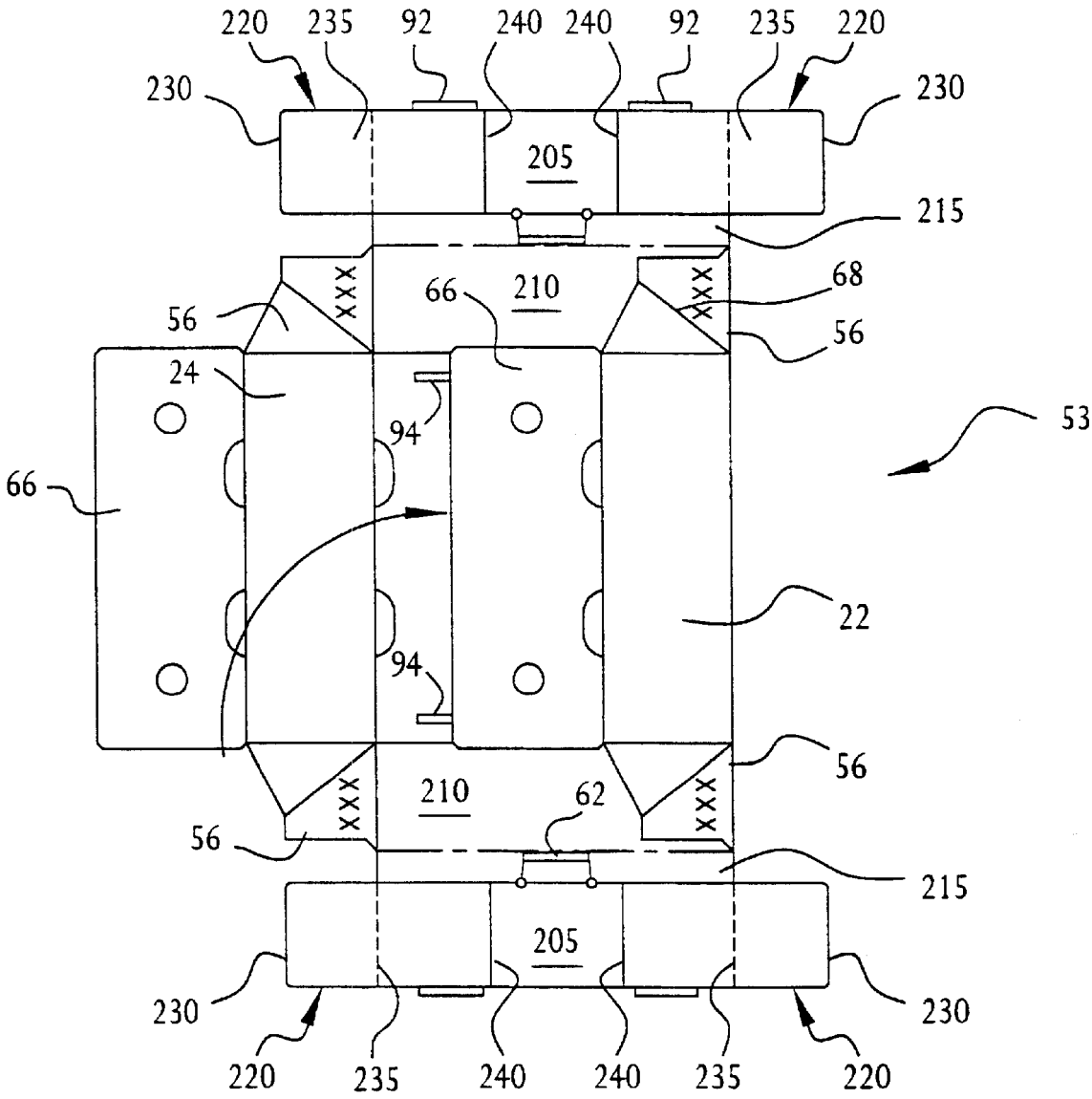
FIG. 10 is a plan view of the integral flat blank of FIG. 9, showing the gluing and folding operations associated with the bellows corners.

FIG. 9 shows the gluing and folding operation associated with affixing wing-forming panels 225 to the surface of interior panel 205, including folding wing-forming panels 225 inwardly to form wing 220. FIG. 10 illustrates the step of gluing the bellows corners 56 to interior panel 205, including folding front wall 22 and back wall 24 over bottom 28. In KDF configuration 53, the blank is compact inasmuch as the internal volume of the container is substantially completely collapsed. The KDF blank 53 can be stacked and bound for shipment to a packer who erects the containers prior to packing them with product. The erection of container 200 is a simple operation, the same worker who loads the containers can easily erect them immediately prior to packing.

Figure 11:
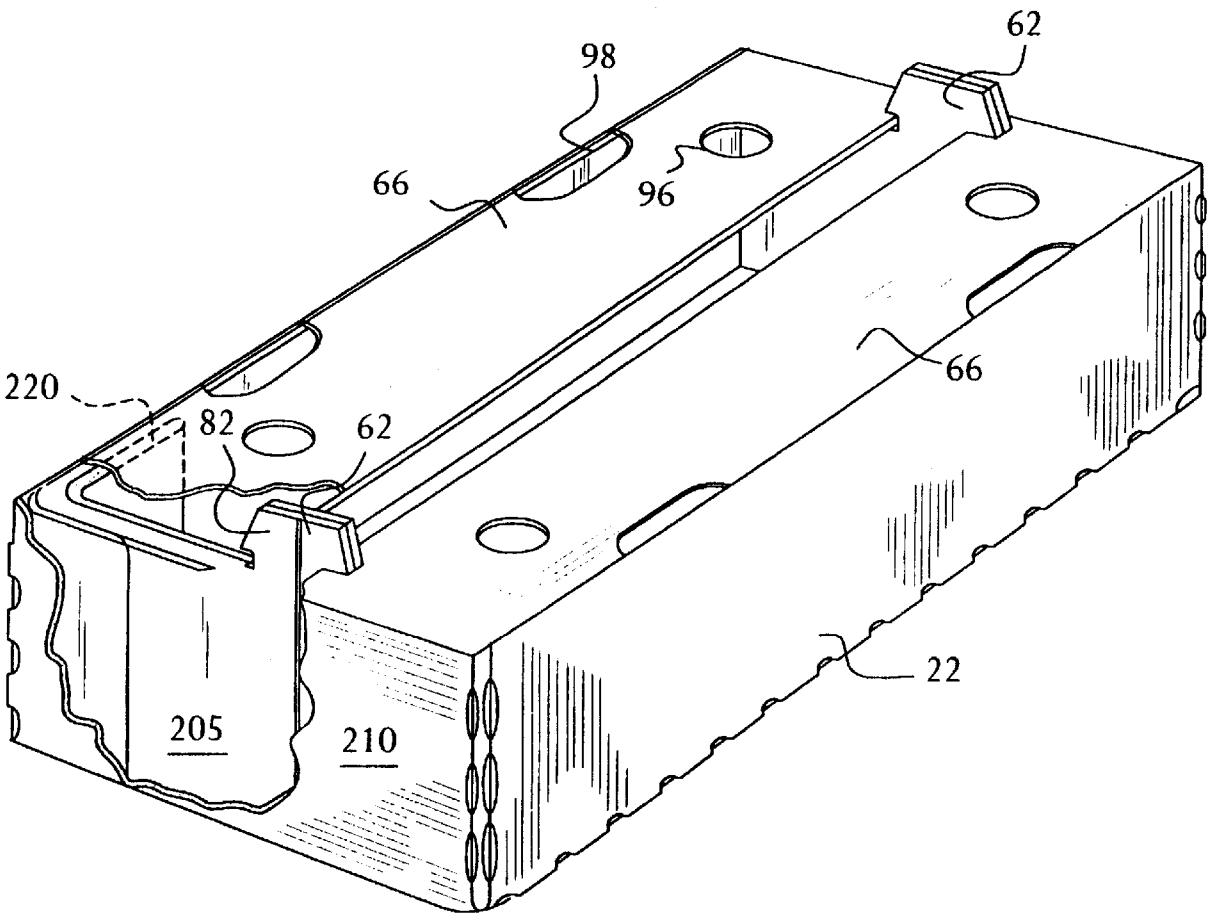
FIG. 11 is a perspective view of the container of FIG. 7, shown with the exterior panel partly cut away.

Container 200 is erected from KDF state 53, shown in FIG. 10, to the erected state shown in FIG. 11, wherein resilient wings 220 project inwardly, into container 200, along portions of front wall 22 and back wall 24. Erection of container 200 is accomplished in much the same way as erection of container 20. According to an inventive aspect, the wing-forming panels 225 are not permanently folded, in the KDF state, along fold line 235. Instead, a pre-crease is formed on each wing 220 to resiliently bias it inwardly, so that each will tend to exert an outwardly directed reactive force when positioned against an adjacent portion of either front wall 22 or back wall 24, as shown in FIGS. 7 and 11. In order to fit interior panel 205 and resilient wings 220 between front wall 22 and back wall 24, the worker presses resilient wings 220, laterally inwardly while rotating the interior panel 205 downwardly to engage locking tabs 92 in receptacles 94. In this way, resilient wings 220 behave like deformed cantilevered beams. As interior panel 205 enters the space between front wall 22 and back wall 24, lateral inward pressure is exerted on resilient wing 220 by the front wall 22 and rear wall 24. The result is a snug fit that further stiffens, strengthens, and supports the front and back walls of container 200. This embodiment like the previous embodiment forms vertical support structures using fold-and-glue arrangements at the wings of the end panel in a manner that permits inward pressure from the front and back walls to press the vertical support structures into their deployed position. Unlike the hollow column arrangement, however, in this embodiment the plural layers that make up the vertical supports can be glued along their full contacting area rather than at spaced positions as necessary to open a hollow column.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A container comprising:

a plurality of panels defining a bottom, a laterally opposite front wall and a back wall, and longitudinally opposite end walls, the end walls having an outer end wall panel joined to the bottom, a ledge panel joined to the outer end wall panel, and an inner end wall panel joined to the ledge panel, at least one column-forming panel being joined to one of the inner and outer end wall panels, the column-forming panel being folded laterally inwardly and being expandable to form a hollow column supporting the ledge panel in the erected state of the container, further comprising inwardly folded bellows panels extending between the end walls and the front and the back and connecting the front and the back to the end walls such that when one of the front, the back and the end walls is pulled upwardly, said one pulls another from a knocked-down-flat configuration to an orientation perpendicular to the bottom.

2. The container of claim 1, wherein the bottom, front wall, back wall, inner end wall panel, ledge panel, outer end wall panel and column-forming panel are cut from an integral flat sheet.

3. The container of claim 1, wherein two said column-forming panels are provided on an inner end wall panel at each longitudinal end of the container.

4. The container of claim 1, wherein the bellows panels each have two parts joined at a fold oriented substantially diagonally relative to an adjacent end wall and one of the front or back, one of said two parts being attached to one of said adjacent end wall, front and back.

5. The container of claim 1, wherein the column-forming panel extends laterally beyond the inner end wall panel and is folded laterally inwardly along a fold line spaced laterally outwardly from a fold line joining the bottom to one of the front and the back, the column-forming panel being attached to the inner end wall panel exclusively at a space from said fold line of the column-forming panel, and the hollow column bearing against an inside surface of one of the front and the back in an erected state of the container.

6. The container of claim 1, wherein the column-forming panel comprises a plurality of score and fold lines spaced to define corners of the hollow column.

7. The container of claim 6, wherein a laterally innermost one of said score and fold lines is substantially parallel to a fold line between the bottom of the container and one of said front and said back, whereby said one of the front and the back limits a position of the hollow column in an erected state of the container, thereby holding open the hollow column.

8. The container of claim 1, wherein the inner end wall panel comprises locking tabs engageable with corresponding locking tab openings in the bottom.

9. A container comprising:

a plurality of panels defining a bottom, a laterally opposite front wall and a back wall, and longitudinally opposite end walls, the end walls having an outer end wall panel joined to the bottom, a ledge panel joined to the outer end wall panel, and an inner end wall panel joined to the ledge panel, at least one column-forming panel being joined to one of the inner and outer end wall panels, the column-forming panel being folded laterally inwardly and being expandable to form a hollow column supporting the ledge panel in the erected state of the container, wherein two column-forming panels are symmetrically folded laterally inwardly from opposite sides of each inner end wall panel, each of the column forming panels comprising part of a protruding registration tab at an end glued to the inner end wall panel.

10. The container of claim 9, wherein each inner end wall panel has a locking tab extending longitudinally of the container, the locking tab engaging in a corresponding locking tab receptacle in the bottom of the container when the inner end wall panel is folded into a space between the front and back.

11. The container of claim 10, wherein a registration tab is cut from the ledge panel and is aligned with said protrusion such that the protrusion and the registration tab cut from the ledge panel form a plural thickness stacking tab aligned to said opening in the bottom of the container.

12. The container of claim 11, comprising two opposite said column forming panels one each said inner wall panel, the opposite column forming panels each comprising a protrusion, the plural thickness stacking tab comprising the registration tab cut from the ledge panel and said protrusions of said opposite column forming panels.

13. The container of claim 10, further comprising a top panel attached to one of the front and the back, the top panel being foldable laterally inwardly to define a lid on the container.

14. The container of claim 13, comprising opposite said top panels attached to each of the front and the back, and wherein the opposite top panels are structured to engage with the registration tab for holding the lid closed.

15. The container of claim 14, wherein the opposite top panels are dimensioned to engage against opposite edges of the registration tab.

16. The container of claim 15, wherein the registration tab has a stepped edge on said opposite edges and the top panels are dimensioned to pass the stepped edge, whereby the registration tab forms a barb holding the opposite top panels closed.

17. A container comprising:

a plurality of corrugated paperboard panels defining a bottom, a laterally opposite front wall and a back wall having top panel flaps, and longitudinally opposite end walls, said panels being integral parts of a single piece of flat stock;

wherein the bottom is attached to the front wall and to the back wall by inwardly folded bellows panels, each having a fold oriented substantially diagonally relative to an adjacent one of the end walls and the front and back and being glued to said adjacent one of the end walls, whereby the bellows panels and the end walls pull one another perpendicular to the bottom when erected;

wherein the end walls comprise an outer end wall panel joined at a fold to a ledge panel, and an inner end wall panel joined at a fold to the ledge panel;

each of the inner end wall panels being joined at a plurality of score and fold lines to laterally opposite column-forming panels, the column forming panels being folded inwardly and glued to a face of the inner end wall panel at a space from the fold and score lines such that the column-forming panels and their respective inner end wall panel are openable into a hollow column, the fold and score lines being placed to define corners of the hollow column and a laterally innermost one of said score and fold lines being substantially parallel to a fold line between the bottom of the container and one of said front and said back, whereby said one of the front and the back limits a position of the hollow column in an erected state of the container, thereby holding open the hollow column.

18. The container of claim 17, wherein the end walls each comprise a registration tab extending upwardly from the ledge panel and the bottom has a registration tab opening aligned with the registration tab whereby the container is stackable in registry with another similar container.

19. The container of claim 18, wherein the registration tab comprises one thickness cut from the ledge panel and a second thickness provided by a protrusion of the column-forming panel.

20. The container of claim 19, wherein the registration tab has laterally opposite stepped edges dimensioned such that edges of the top panel flaps pass and are locked down by the stepped edges when the top panel flaps are folded downwardly to engage the registration tab.

21. A container comprising:

a bottom;

a front wall;

a rear wall;

two end walls positioned in confronting relation to one another between said front wall and said rear wall so that (i) a first vertical side of each end wall is positioned adjacent to a portion of said front wall, and (ii) a second vertical side of each end wall is positioned adjacent to a portion of said rear wall; and two wings, one projecting into said container from said first vertical edge and one projecting into said container from said second vertical edge of each of said end walls, with each of said wings biased so as to be in supporting engagement with said portions of said adjacent walls;

wherein said end walls each comprise an exterior panel joined to said bottom, a ledge panel joined to said exterior panel, and an interior panel joined to said ledge panel;

wherein said interior panel of each end wall comprises said first vertical side and said second vertical side; and, further comprising inwardly folded bellows panels extending between and connecting said end walls and said front and said back walls such that when one of said front, said back and said end walls is pulled upwardly, said one pulls another from a knocked-down-flat configuration to an orientation perpendicular to said bottom.

22. A container according claim 21 wherein said bottom, said front wall, said rear wall, said interior panel, said ledge panel, and said exterior panel are cut from an integral flat sheet.

23. A container according claim 21 wherein said bellows panels each have two parts joined at a fold oriented substantially diagonally relative to an adjacent end wall and one of said front wall or said back wall, one of said two parts being attached to one of said adjacent end walls, and one of said front wall or said back wall.

24. A container according claim 22 wherein each interior panel has a locking tab extending longitudinally of the container, the locking tab engaging in a corresponding locking tab receptacle in the bottom of the container when the inner end wall panel is folded into a space between the front and back.

25. A container according claim 22 wherein a registration tab is cut from the ledge panel and is aligned with said protrusion such that the protrusion and the registration tab cut from the ledge panel form a plural thickness stacking tab aligned to said opening in the bottom of the container.

26. A container according claim 25 wherein the opposite top panels are dimensioned to engage against opposite edges of the registration tab.

27. A container according claim 26 wherein the registration tab has a stepped edge on said opposite edges and the top panels are dimensioned to pass the stepped edge, whereby the registration tab forms a barb holding the opposite top panels closed.

28. A container according claim 27 wherein the inner end wall panel comprises locking tabs engageable with corresponding locking tab openings in the bottom.

* * * * *